US006925769B2

(12) United States Patent
Schmaltz, Jr.

(10) Patent No.: US 6,925,769 B2
(45) Date of Patent: Aug. 9, 2005

(54) CONCRETE JAR STEP INSERT

(76) Inventor: Rodney J. Schmaltz, Jr., 13053 Dale Dr., Ponchatoula, LA (US) 70454

( * ) Notice: Subject to any disclaimer, the term of this patent is extended or adjusted under 35 U.S.C. 154(b) by 441 days.

(21) Appl. No.: 10/142,304

(22) Filed: May 9, 2002

(65) Prior Publication Data

US 2003/0209821 A1 Nov. 13, 2003

(51) Int. Cl.[7] ..... E04C 3/30

(52) U.S. Cl. ..... 52/576; 52/704; 52/707; 52/20

(58) Field of Search ..... 52/576, 704, 741.2, 52/184, 189, 20, 19, 707, 710, 651.1; 182/228.6, 87, 178.1–178, 92, 94; 249/10

(56) References Cited

U.S. PATENT DOCUMENTS

| | | | | |
|---|---|---|---|---|
| 890,573 A | | 6/1908 | Phelan | |
| 1,093,204 A | | 4/1914 | Pitts | |
| 3,974,615 A | * | 8/1976 | Ditcher | 52/698 |
| 4,008,550 A | * | 2/1977 | Kaufman | 52/298 |
| 4,084,780 A | | 4/1978 | Mess | |
| 4,195,709 A | | 4/1980 | Gianotti et al. | |
| 4,241,543 A | | 12/1980 | Foscarini et al. | |
| 4,365,780 A | | 12/1982 | Williams | |
| 4,655,318 A | | 4/1987 | Bowen | |
| 5,174,910 A | | 12/1992 | Pita | |
| 5,653,078 A | | 8/1997 | Kies et al. | |
| 6,315,077 B1 | * | 11/2001 | Peacock et al. | 182/92 |

FOREIGN PATENT DOCUMENTS

| | | |
|---|---|---|
| CA | 1107543 | 8/1981 |
| JP | 60019833 | 2/1985 |

* cited by examiner

*Primary Examiner*—Carl D. Friedman
*Assistant Examiner*—Chi Q. Nguyen
(74) *Attorney, Agent, or Firm*—Andre J. Porter; John H. Runnels; Bonnie J. Davis

(57) ABSTRACT

In accordance with the present invention there is provided an insert for placement in a mold for forming a concrete jar to form holes in the interior of the concrete jar for receiving steps and a method for forming holes in the interior of a concrete jar or manhole casing for receiving steps to enable a worker to climb into and out of said concrete jar or manhole casing, the insert including two hollow tubular anchors, each of the anchors having a first end and a second end, each of the anchors being equal in length, a rigid frame connected to the first end of each of the two anchors, the frame having a front side and a back side, the two hollow anchors extending from the front side of the frame, the anchors being parallel to each other, and the anchors being closed at the first end and open at the second end.

14 Claims, 5 Drawing Sheets

CONCRETE JAR STEP INSERT

BACKGROUND OF THE INVENTION

1. Field of the Invention

The present invention relates to the construction of concrete products. In particular the present invention relates to devices for forming holes in hollow concrete manhole casings or concrete jars for receiving steps to enable workmen to enter and exit the interior of the manhole casings or concrete jars.

2. Description of the Related Art

In many construction projects such as roads, sewers, and large buildings, concrete manhole casings are installed to provide access to underground sewers, and tunnels containing water and steam pipes and electrical cables. Such concrete manholes are constructed from concrete reinforced with steel and may be circular or square in cross-section. Commonly, the diameter of such concrete manholes may range from three feet to six feet and the height is selected to extend from the surface of the ground downward to the depth of the tunnel to which access is desired.

Many such concrete manhole casings or concrete jars are pre-cast at a location remote from the construction site and shipped to the site after casting and curing. Such reinforced concrete manhole casings are sometimes referred to in the art and herein as jars or concrete jars.

Commonly, after concrete is poured into a mold to form a jar, after the concrete hardens to the point where the mold can be removed, concrete drills are used to drill holes in the interior walls of the jar to receive steps to enable a workman to enter and exit the jar. Such drilling is slow and difficult, and therefore adds significantly to the cost of the jar. Since the jar is reinforce with steel rod or wire, the drill sometimes strikes the steel and increases the difficulty of drilling holes for receipt of steps.

Exemplary of the related art are the following patents: U.S. Pat. Nos. 5,653,078; 5,174,910; 4,655,318; 4,365,780; 4,241,543; 4,195,709; 4,084,780; 1,093,204; 890,573; Canadian Patent 1,107,543; and Japanese Patent 60019833.

BRIEF SUMMARY OF THE INVENTION

In accordance with the present invention there is provided an insert for placement in a mold for forming a concrete jar to form holes in the interior of the concrete jar for receiving steps and a method for forming holes in the interior of a concrete jar or manhole casing for receiving steps to enable a worker to climb into and out of the concrete jar or manhole casing.

The step insert of the invention has the advantage of being quickly and easily connected to the reinforcing members of the jar.

The step insert of the invention has the additional advantage of being inexpensive.

DETAILED DESCRIPTION OF THE INVENTION

Figure 1:
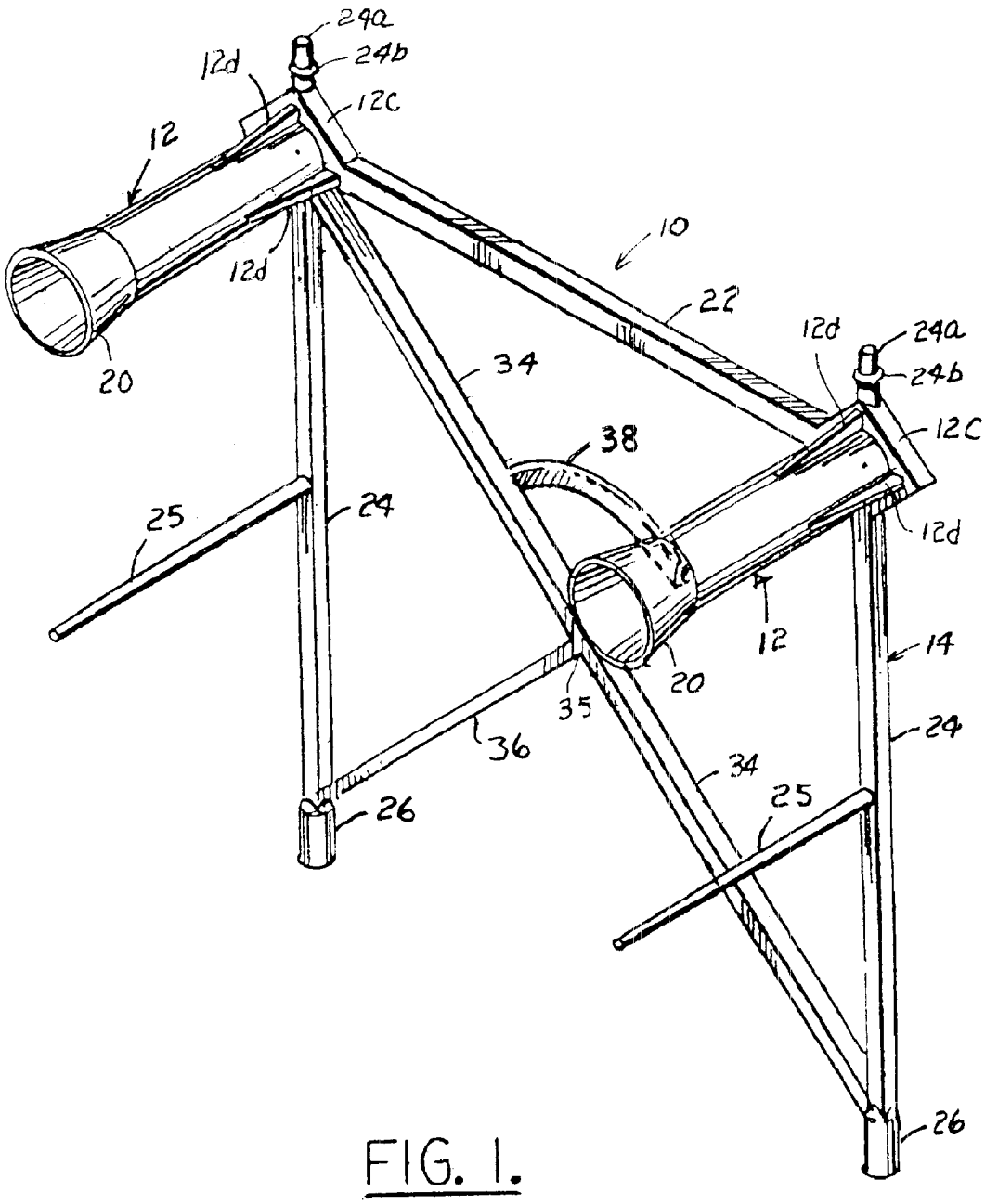
FIG. 1 is perspective view of a step insert of the invention.
Figure 2:
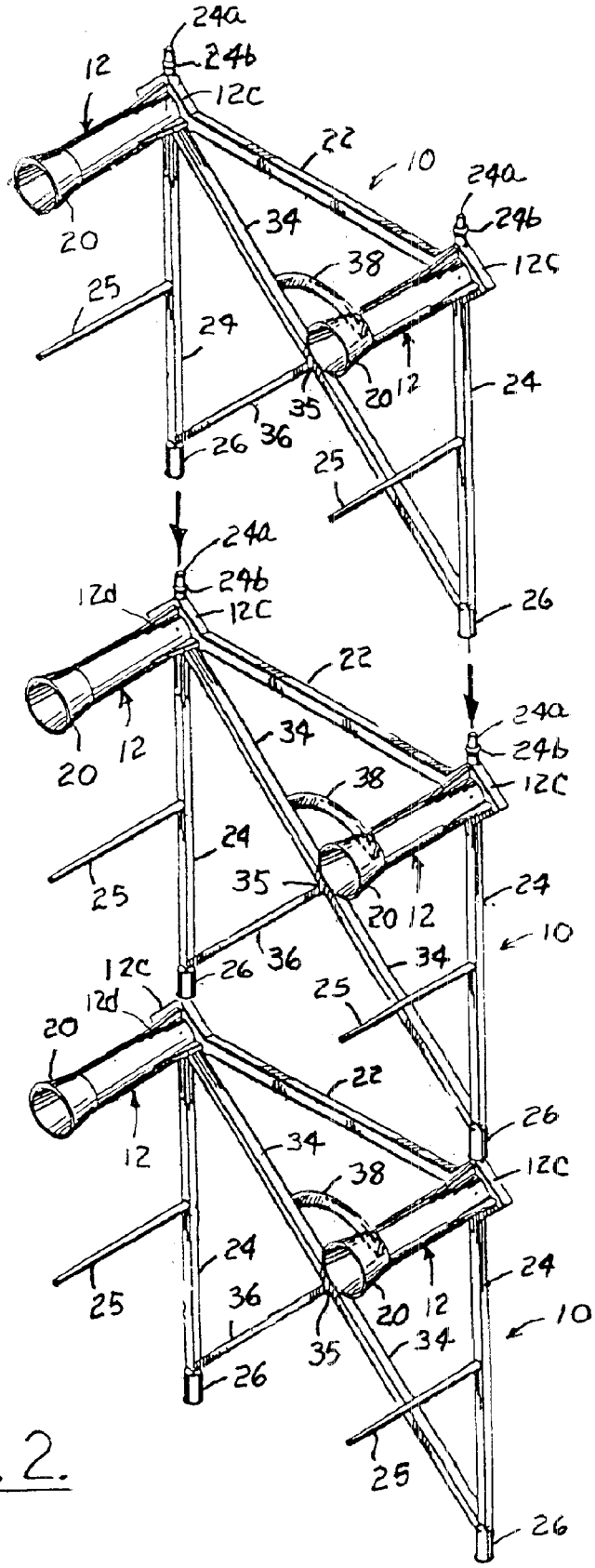
FIG. 2 is perspective, exploded view of one of the step inserts of the invention aligned for joining with two other joined step inserts of the invention.

Referring now to the drawings, and in particular to FIGS. 1 and 2, the step insert of the invention is generally indicated by the numeral 10. Step insert 10 is preferably integrally formed from any high strength polymeric plastic compound well known in the art, preferably reinforced with glass fibers, or the like. However, if desired step insert 10 could be formed from metals such as aluminum or steel alloys, or the like.

Figure 4:
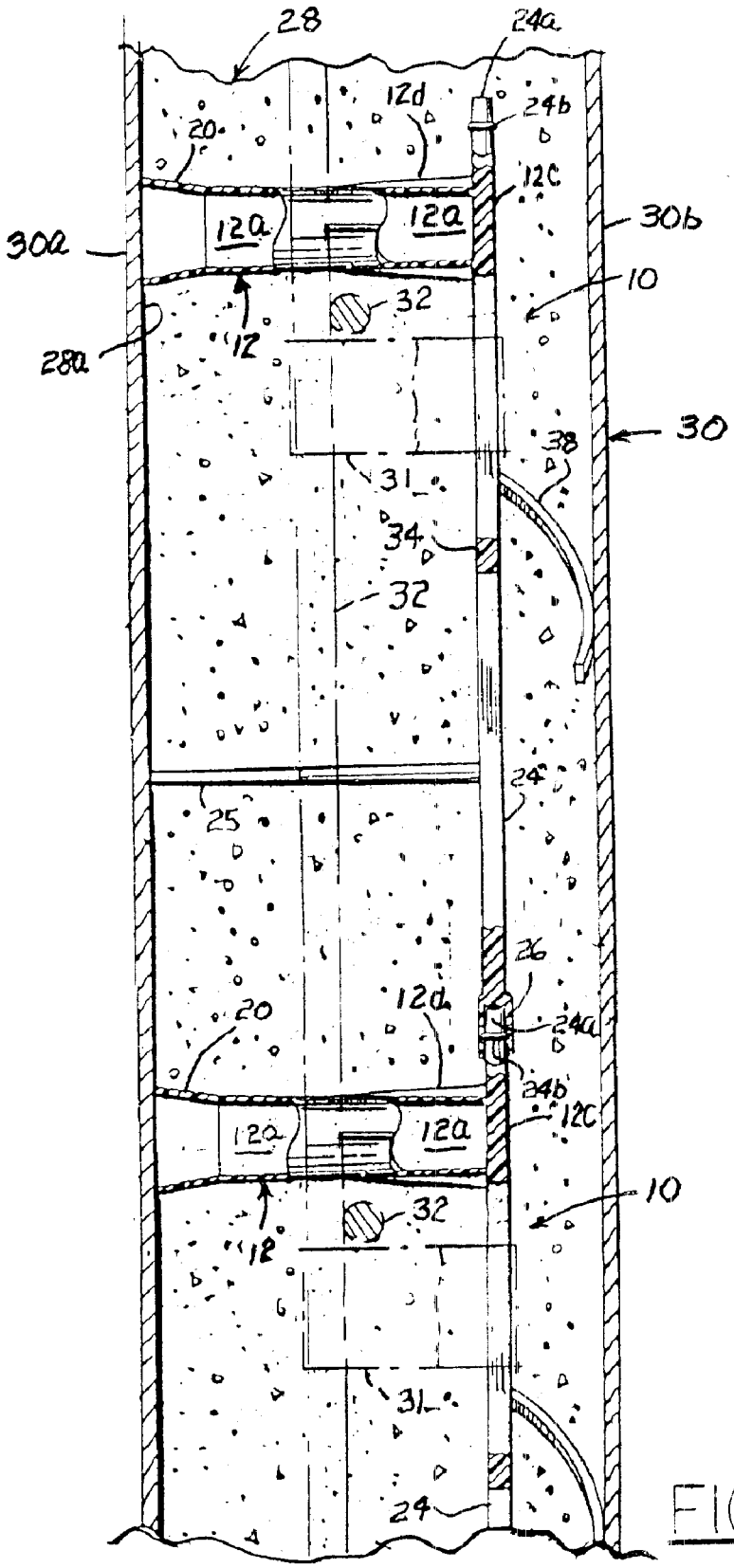
FIG. 4 is an enlarged partly cut-away cross-sectional view of a portion of a wall of ajar having the insert of the invention therein.
Figure 5:
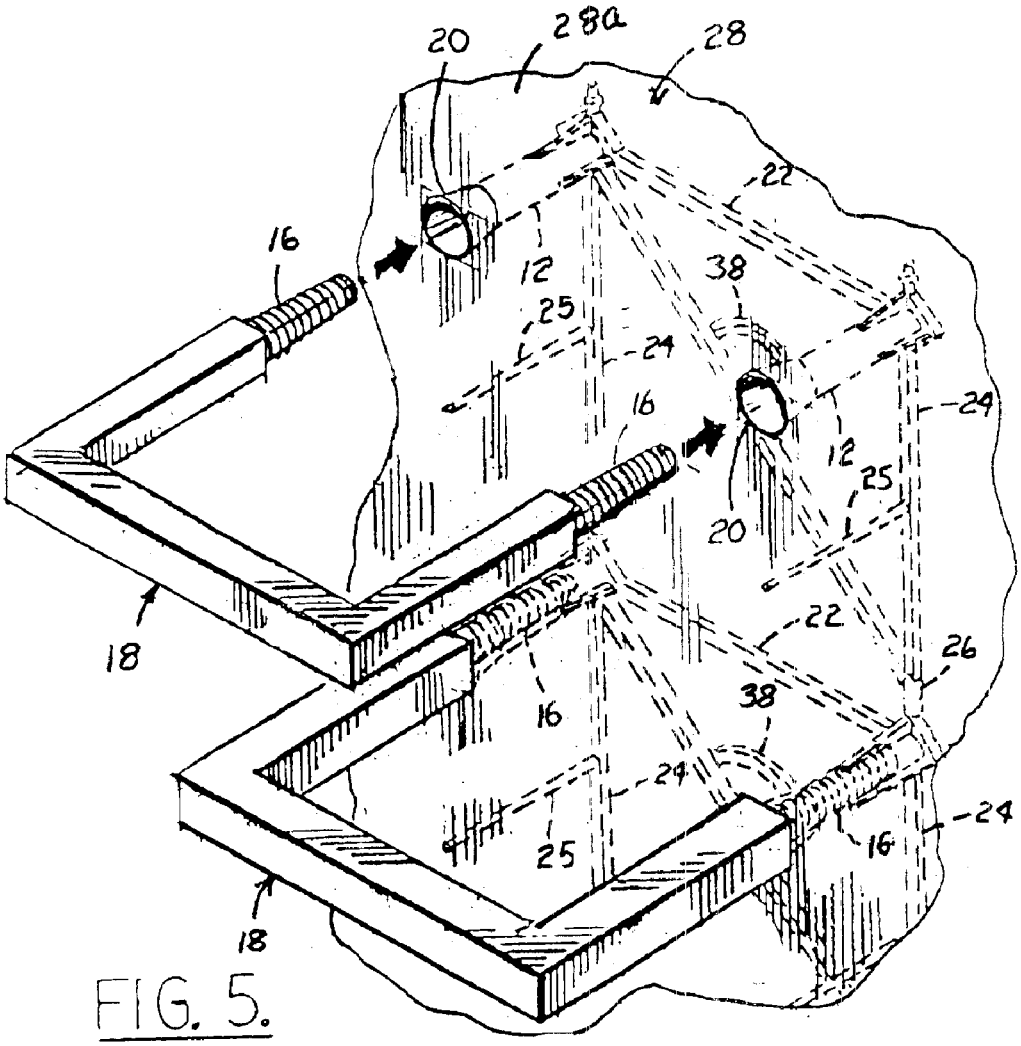
FIG. 5 is a perspective view of a step aligned for insertion into a step insert of the invention shown in phantom lines shown inside the wall of a concrete jar formed in a mold.

Step insert 10 includes two anchors generally indicated by the numeral 12 integrally formed with a frame generally indicated by the numeral 14. Anchors 12—12 are generally cylindrical in shape and have a hollow interior 12*a* as shown in FIG. 4. Anchors 12—12 are sized to receive studs 16 therein of the step generally indicated by the numeral 18 as shown in FIG. 5. Studs 16 preferably have a plurality of circular ridges thereon as known in the art which are force fitted into the interior of hollow anchors 12 to securely attach studs 16 thereto. Anchors 12—12 preferably have an open conical hollow end portion 20 to enable easy alignment and insertion of stud 16 therein. Anchors 12—12 are connected at their base to solid base plates 12*c* which close the base to prevent fluid concrete from flowing into the interior 12*a* of anchor 12 as shown in FIG. 4. Fins 12*d* may be provided on anchor 12 and base plate 12*c* to provide increased strength and support for anchor 12.

Figure 3:
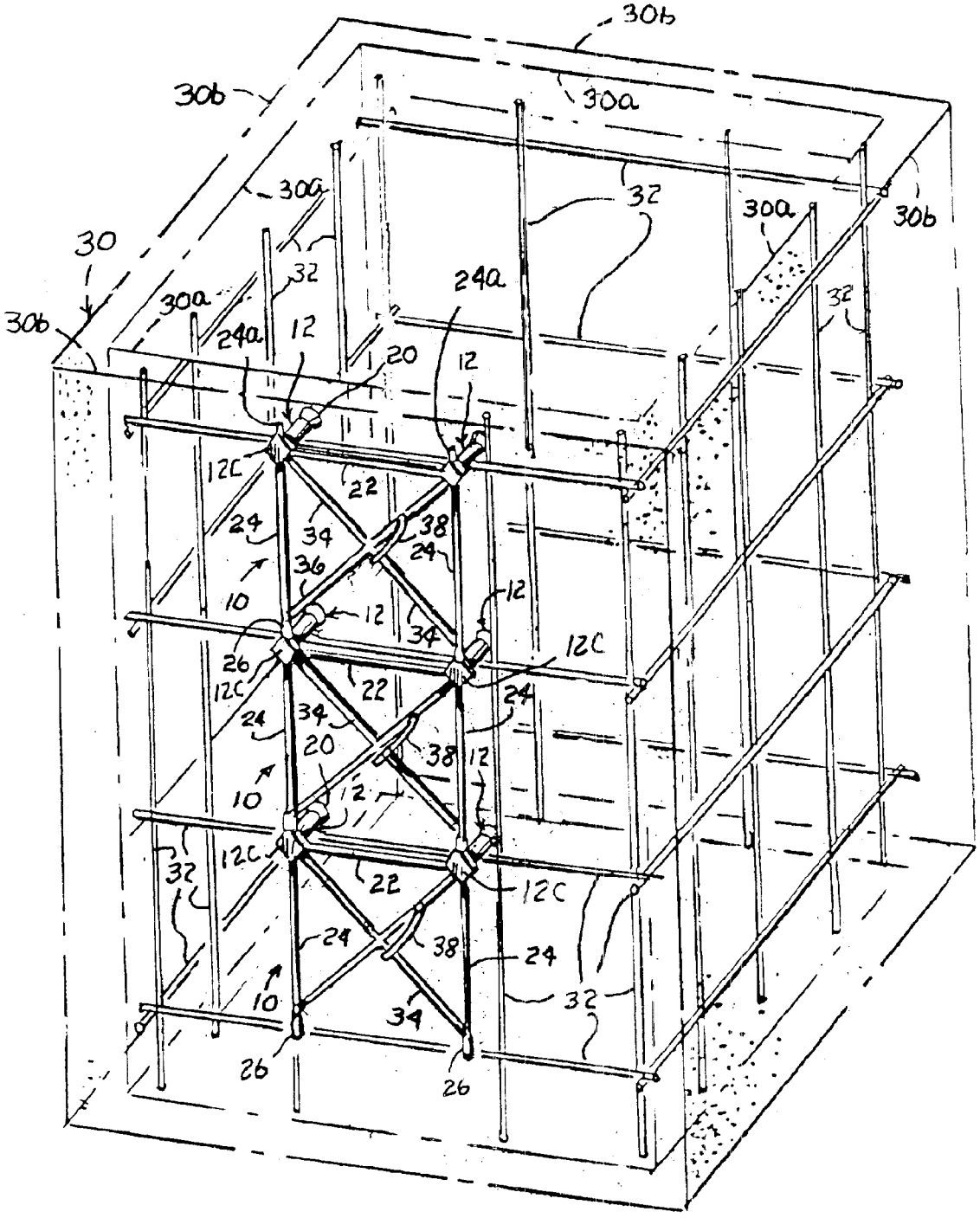
FIG. 3 is a perspective view of three step inserts of the invention connected to reinforcing members located inside of a concrete jar mold shown in phantom lines.

Frame 14 is generally rectangular in shape and includes a horizontal strut 22 connected to base plates 12*c* and two parallel vertical legs 24—24 connected to base plates 12*c* oriented perpendicular to horizontal strut 22 and anchors 12 and preferably formed integrally therewith. Base plates 12*c* each have a conical pin or fastener 24*a* aligned with vertical leg 24 at the upper end thereof preferably having a circular ridge 24*b* at the base thereof. At the bottom end of each of the vertical legs 24—24 is a hollow sleeve or fastener 26. As can be seen in FIGS. 2–4, pin 24*a* of a lower step insert 10 is force-fitted into sleeve 26 of an adjacent upper step insert 10 to connect two or more step inserts 10 together to extend from the top of a concrete jar or manhole casing generally indicated by the numeral 28 to the bottom of the concrete jar 28.

Figure 6:
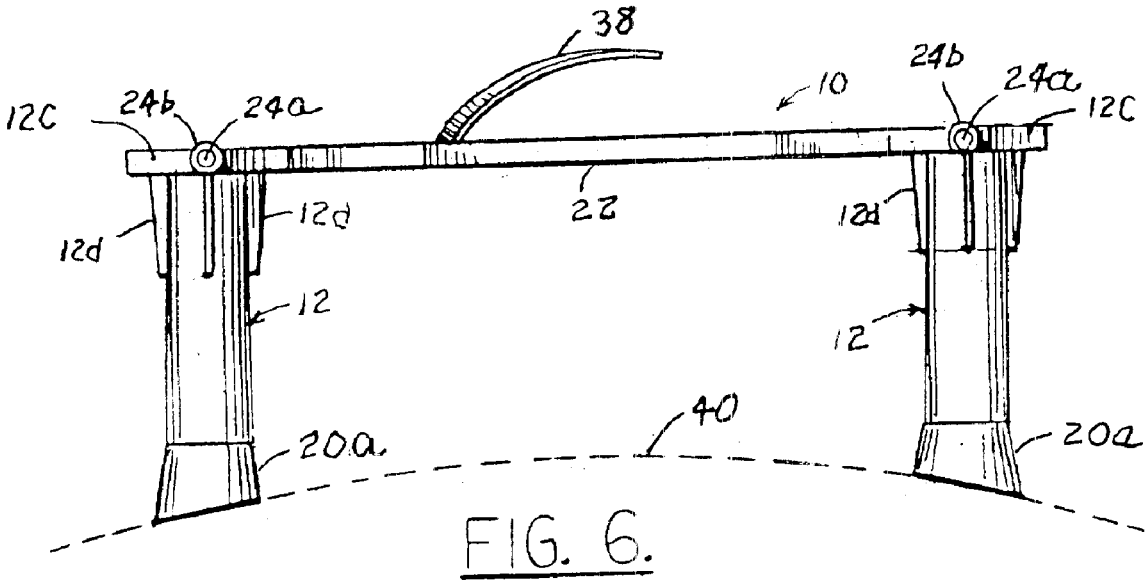
FIG. 6 is a side view of an additional embodiment of the step insert of the invention shown aligned with the interior wall of a cylindrical jar shown in phantom lines inside a mold.

Concrete jar or manhole casing 28 utilizing the step insert 10 of the invention is shown in FIGS. 4–6 inside of a conventional concrete jar mold or form well known in the art or form generally indicated by the numeral 30. Concrete jar mold or form 30 has an inside wall 30*a* and an outside wall 30*b*. Reinforcing metal rods 32 are located inside of mold 30 and tied together with wire or any other fastener as is known in the art. Step inserts 10 are oriented in mold 30 to locate the conical hollow end portions 20 flush with the face 28*a* of the interior wall of the concrete jar or manhole casing 28 to prevent concrete from entering the anchors 12 when fluid concrete is poured into the walls 30*a* and 30*b* of concrete jar mold 30 and enable insertion of studs 16 therein.

After step inserts 10 are oriented as indicated above, step inserts 10 are preferably tied with tape such as duct tape 31 shown in FIG. 4 to reinforcing rod 32, but wire or any other fastener known in the art may be used to fasten the step inserts 10 to the reinforcing rods 32. Fluid concrete is then poured in mold 30 and allowed to dry to a rigid state. The interior walls 30*a* and the exterior walls 30*b* of form or mold 30 are then removed as is known in the art, and steps 18 are attached to step inserts 10 as shown in FIG. 5 and as explained above to enable a worker to climb into and out of concrete jar 28.

Preferably, each leg 24 has a positioning post 25 extending perpendicularly therefrom in the same direction as anchor 12 to assist in orienting the step inserts 10 in mold 30 to locate the conical hollow end portions 20 flush with the interior wall 30*a* of mold 30 and flush with the face 28*a* of the interior wall of the concrete jar or manhole casing 28 as shown in FIG. 4. Each positioning post 25 is parallel to the central axis of the anchor 12 located immediately above on vertical leg 24 and is equal in length to the length of anchor 12. Positioning posts 25 are positioned to rest against the interior wall 30*a* of concrete form or mold 30. Although positioning posts 25 are preferred, if desired, positioning posts 25 could be omitted.

Step insert 10 preferably has two cross beams 34 and 36 for additional strength. Cross beam 34 extends from base plate 12*c* at the top of one leg 24 to the bottom of the adjacent leg 24 and cross beam 36 extends from base plate 12*c* at the top of the other leg 24 to the bottom of the adjacent leg 24. Preferably, cross beams 34 and 36 are joined at their midpoint 35. Although cross beams 34 and 36 are preferred, if desired, cross beams 34 and 36 could be omitted.

Preferably, cross beam 34 has a flexible tab 38 extending rearwardly therefrom in the opposite direction as anchor 12 to assist in orienting the step inserts 10 in mold 30 to locate the conical hollow end portions 20 flush with the interior wall 30*a* of mold 30 and flush with the face 28*a* of the interior wall of the concrete jar or manhole casing 28 as shown in FIG. 4. The length of tab 38 is selected to enable tab 38 to rest against the interior face of exterior wall 30*b* of concrete form or mold 30 and bias the conical hollow end portions 20 of anchor 12 flush with the face 28*a* of the concrete jar or manhole casing 28. Although tab 38 is preferred, if desired, tab 38 could be omitted.

In FIG. 6 is shown an additional embodiment of the step insert 10 of the invention wherein the conical hollow end portions 20*a* are curved at the outer end for use in a cylindrical concrete jar or manhole casing 28 having a cylindrical interior wall 40. The remainder of the step insert 10 shown in FIG. 6 is identical to the step insert 10 shown in FIGS. 1–5.

Although the preferred embodiments of the invention have been described in detail above, it should be understood that the invention is in no sense limited thereby, and its scope is to be determined by that of the following claims:

What is claimed is:

1. A step insert for placement inside a hollow mold for receiving fluid concrete to construct a concrete manhole casing, said mold having an interior wall and an exterior wall, said step insert being utilized to form holes in the interior of said concrete jar for receiving steps to enable a worker to climb into and out of said concrete manhole casing, said step insert comprising:

a. two hollow tubular anchors, each of said anchors having a first end and a second end, each of said anchors being equal in length, and b. a rigid frame connected to said first end of each of said two anchors, said frame having a front side and a back side, said two hollow anchors extending from said front side of said frame, said anchors being parallel to each other, said anchors being closed at said first end and open at said second end, said frame having a plurality of fasteners, said fasteners comprising a pin and a sleeve for receiving said pin.

2. A step insert for placement inside a hollow mold for receiving fluid concrete to construct a concrete manhole casing, said mold having an interior wall and an exterior wall, said step insert being utilized to form holes in the interior of said concrete jar for receiving steps to enable a worker to climb into and out of said concrete manhole casing, said step insert comprising:

a. two hollow tubular anchors, each of said anchors having a first end and a second end, each of said anchors being equal in length, b. a rigid frame connected to said first end of each of said two anchors, said frame having a front side and a back side, said two hollow anchors extending from said front side of said frame, said anchors being parallel to each other, said anchors being closed at said first end and open at said second end, said frame having a plurality of fasteners connected to said frame for fastening one of said step inserts to another of said step inserts with said two anchors of one of said step inserts oriented parallel to said two anchors of said other step insert with said second ends of all of said anchors tying in a plane, said fasteners comprising a pin and a sleeve for receiving said pin.

3. The step insert of claim 1 wherein said frame has a flexible tab connected thereto for biasing said frame in a desired direction.

4. The step insert of claim 1 wherein said frame has at least two positioning posts connected thereto, said positioning posts being parallel to said anchors and being located on said front side of said frame.

5. The step insert of claim 4 wherein said positioning posts are equal in length to the length of said anchors.

6. The step insert of claim 1 wherein said frame is generally rectangular in shape, said frame having i. a horizontal strut connected to perpendicularly to each of said two anchors, and ii. a vertical leg connected to perpendicularly to each of said two anchors, said vertical legs being parallel and oriented perpendicularly to said horizontal strut.

7. The step insert of claim 6 wherein said vertical legs have two cross beams connected thereto.

8. The step insert of claim 1 wherein one of said cross beams has a flexible tab connected thereto for biasing said frame in a desired direction.

9. The step insert of claim 2 wherein said frame has a flexible tab connected thereto for biasing said frame in a desired direction.

10. The step insert of claim 2 wherein said frame has at least two positioning posts connected thereto, said positioning posts being parallel to said anchors and being located on said front side of said frame.

11. The step insert of claim 10 wherein said positioning posts are equal in length to the length of said anchors.

12. The step insert of claim 2 wherein said frame is generally rectangular in shape, said frame having i. a horizontal strut connected to perpendicularly to each of said two anchors, ii. a vertical leg connected to perpendicularly to each of said two anchors, said vertical legs being parallel and oriented perpendicularly to said horizontal strut.

13. The step insert of claim 12 wherein said vertical legs have two cross beams connected thereto.

14. The step insert of claim 2 wherein one of said cross beams has a flexible tab connected thereto for biasing said frame in a desired direction.

* * * * *